US008651046B1

(12) United States Patent
Davancens et al.

(10) Patent No.: US 8,651,046 B1
(45) Date of Patent: Feb. 18, 2014

(54) ROBOTIC SEALANT AND END EFFECTOR

(75) Inventors: Angelica Davancens, Reseda, CA (US); Branko Sarh, Huntington Beach, CA (US)

(73) Assignee: The Boeing Company, Chicago, IL (US)

( * ) Notice: Subject to any disclaimer, the term of this patent is extended or adjusted under 35 U.S.C. 154(b) by 348 days.

(21) Appl. No.: 12/842,247

(22) Filed: Jul. 23, 2010

(51) Int. Cl.

| | |
|---|---|
| ***B05C 5/02*** | (2006.01) |
| ***B05C 5/00*** | (2006.01) |
| ***B05D 5/10*** | (2006.01) |
| ***B05D 5/00*** | (2006.01) |

(52) U.S. Cl.
USPC ..... 118/323; 118/300; 901/43; 901/41; 901/30; 901/47; 901/46; 427/207.1

(58) Field of Classification Search
USPC ..... 427/374.4
See application file for complete search history.

(56) References Cited

U.S. PATENT DOCUMENTS

| | | | | |
|---|---|---|---|---|
| 4,245,812 | A * | 1/1981 | Burger | 251/10 |
| 4,995,148 | A | 2/1991 | Bonomi et al. | |
| 5,148,591 | A * | 9/1992 | Pryor | 29/407.04 |
| 5,174,477 | A * | 12/1992 | Schafer | 222/183 |
| 5,292,368 | A * | 3/1994 | Komine et al. | 118/315 |
| 5,499,474 | A * | 3/1996 | Knooihuizen | 47/1.5 |
| 5,515,599 | A * | 5/1996 | Best | 29/705 |
| 6,001,181 | A | 12/1999 | Bullen | |
| 6,197,115 | B1 * | 3/2001 | Barrey et al. | 118/681 |
| 6,210,084 | B1 | 4/2001 | Banks et al. | |
| 6,292,976 | B1 * | 9/2001 | Kurcz et al. | 15/302 |
| 6,317,953 | B1 * | 11/2001 | Pryor | 29/407.04 |
| 6,379,119 | B1 * | 4/2002 | Truninger | 417/22 |
| 6,659,366 | B1 * | 12/2003 | Walters | 239/152 |
| 7,147,016 | B1 * | 12/2006 | Nelson et al. | 141/114 |
| 7,195,631 | B2 | 3/2007 | Dumbauld | |
| 7,198,739 | B2 * | 4/2007 | La Forest et al. | 264/29.2 |
| 7,963,246 | B1 * | 6/2011 | Brinker | 118/712 |
| 2002/0121527 | A1 * | 9/2002 | Good | 222/94 |
| 2004/0167647 | A1 * | 8/2004 | Ghuman et al. | 700/97 |
| 2005/0161861 | A1 * | 7/2005 | Lammers et al. | 264/255 |
| 2006/0163772 | A1 * | 7/2006 | Lammers et al. | 264/257 |
| 2006/0219760 | A1 * | 10/2006 | Wagoh et al. | 228/248.1 |
| 2007/0131717 | A1 * | 6/2007 | Davies et al. | 222/162 |
| 2008/0060761 | A1 * | 3/2008 | Weaver | 156/408 |
| 2010/0003416 | A1 * | 1/2010 | Lammers et al. | 427/374.4 |
| 2010/0180711 | A1 * | 7/2010 | Kilibarda et al. | 74/490.06 |

* cited by examiner

*Primary Examiner* — Dah-Wei Yuan
*Assistant Examiner* — Jethro Pence
(74) *Attorney, Agent, or Firm* — Yee & Associates, P.C.

(57) ABSTRACT

A method and apparatus for applying sealant. The apparatus may comprise a sealant flow control system. The sealant flow control system may be configured to engage a nozzle of a sealant container to reduce a flow of sealant from the nozzle.

19 Claims, 9 Drawing Sheets

ROBOTIC SEALANT AND END EFFECTOR

BACKGROUND INFORMATION

1. Field

The present disclosure relates generally to manufacturing and, in particular, to sealing structures. Still more particularly, the present disclosure relates to a method and apparatus for applying sealant to structures.

2. Background

In manufacturing products, such as aircraft, parts may be attached to each other to form structures for the aircraft. These structures may include, for example, without limitation, a fuselage, a wing, an engine, a fuel tank, and other suitable structures. In manufacturing different structures for an aircraft, some operations may be more time consuming than desired. For example, forming holes in parts and installing fasteners to attach the parts to each other may take more time than desired.

As another example, the application of sealant may take more time than desired. Sealant may be applied to locations of fasteners, seams, edges, and/or other suitable locations. Requirements may be present for the placement of sealant on a structure. The sealant may be required to be placed with a selected volume, within a defined space, and/or with a selected amount of thickness. For example, without limitation, if sealant is placed between seams between two parts, the sealant may be required to have a selected thickness with respect to the seam. If sealant is placed over a fastener, the sealant may be required to have a selected diameter and/or height with respect to a diameter of the fastener, a height of the fastener, a diameter of the hole, a depth of the hole, a diameter of a countersink, a depth of the counter sink, and/or other suitable parameters.

To meet these types of requirements, inspections, reworking of the sealant, replacement of the sealant, and/or other operations may need to be performed. As a result, the application of sealant in aircraft structures may often be more time consuming than desired and may require skilled operators.

Therefore, it would be advantageous to have a method and apparatus that takes into account at least some of the issues discussed above, as well as other possible issues.

SUMMARY

In one advantageous embodiment, an apparatus may comprise a sealant flow control system. The sealant flow control system may be configured to engage a nozzle of a sealant container to reduce a flow of sealant from the nozzle.

In another advantageous embodiment, a sealant application system for applying sealant to a structure for an aircraft may comprise a structure, a sealant flow control system, a sensor system, a sealant flow generation system, and a robotic arm. The structure may be configured to hold a sealant container having a nozzle in which the structure may be configured for attachment to the robotic arm. The sealant flow control system may be associated with the structure and may be configured to engage the nozzle to reduce a flow of sealant from the nozzle and to clamp the nozzle such that an opening in the nozzle may be reduced in size. The structure and the sealant flow control system form an end effector for a robot. The sealant flow control system may comprise a clamp, a movement system, and a positioning system. The movement system may be configured to move the clamp between an open state and a closed state or an interim state. The movement system may comprise an actuator configured to move the clamp between the open state and the closed state, and a spring configured to bias the clamp towards the open state. The positioning system may be configured to position the clamp relative to the nozzle such that the clamp reduces a size of the opening in the nozzle when in the closed state. The sensor system may be associated with the structure and may be configured to provide information about a position of the nozzle. The sensor system may comprise a number of cameras configured to generate image information about an area around the nozzle. The sealant flow generation system may cause the sealant to move from the sealant container through the nozzle. The sealant flow generation system may comprise a plunger and a motor connected to the plunger in which the motor may be configured to move the plunger. The plunger may be configured to engage the sealant container. The plunger may cause the sealant in the sealant container to move through the nozzle when moved in a direction towards the nozzle. The gear system may connect the motor to the plunger and may be configured to move the plunger.

In yet another advantageous embodiment, a method may be provided for applying sealant. The sealant may be applied through a nozzle from a sealant container to a location on a structure using an end effector. Responsive to a desired amount of sealant being applied to the location, the nozzle may be clamped with a sealant flow control system configured to clamp the nozzle to reduce a flow of the sealant from the nozzle.

In still yet another advantageous embodiment, a method may be provided for applying a sealant to structure for an aircraft. An end effector may be positioned relative to a location on a structure. The location may be selected from a group comprising one of a fastener, a seam, and an edge of the structure. The end effector may comprise a structure configured to hold a sealant container having a nozzle and a sealant flow control system associated with the structure. The structure may be configured for attachment to a robotic arm. The sealant flow control system may be configured to clamp the nozzle to reduce a flow of the sealant from the nozzle. The sealant flow control system may comprise a clamp and a movement system configured to move the clamp between an open state and a closed state or an interim state. The sealant may be caused to move from the sealant container through the nozzle onto the location using a sealant flow generation system for the end effector. The sealant flow generation system may comprise a plunger configured to engage the sealant container and a motor connected to the plunger. The motor may be configured to move the plunger against the sealant and movement of the plunger in a direction towards the nozzle may cause the sealant in the sealant container to move through the nozzle. The flow of the sealant may be reduced when a desired amount of the sealant has been applied to the location.

The features, functions, and advantages can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the advantageous embodiments are set forth in the appended claims. The advantageous embodiments, however, as well as a preferred mode of use, further objectives, and advantages thereof, will best be understood by reference to the following detailed description of an advantageous embodiment of the present disclosure when read in conjunction with the accompanying drawings, wherein:

DETAILED DESCRIPTION

Figure 1:
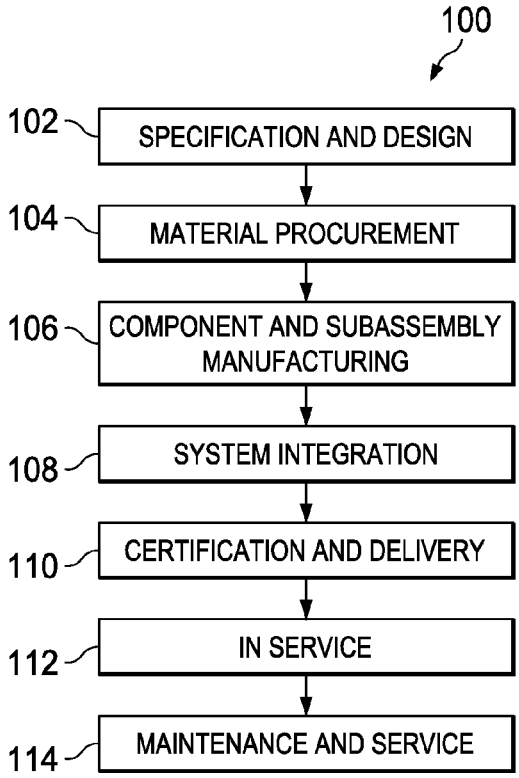
FIG. 1 is an illustration of an aircraft manufacturing and service method in accordance with an advantageous embodiment.
Figure 2:
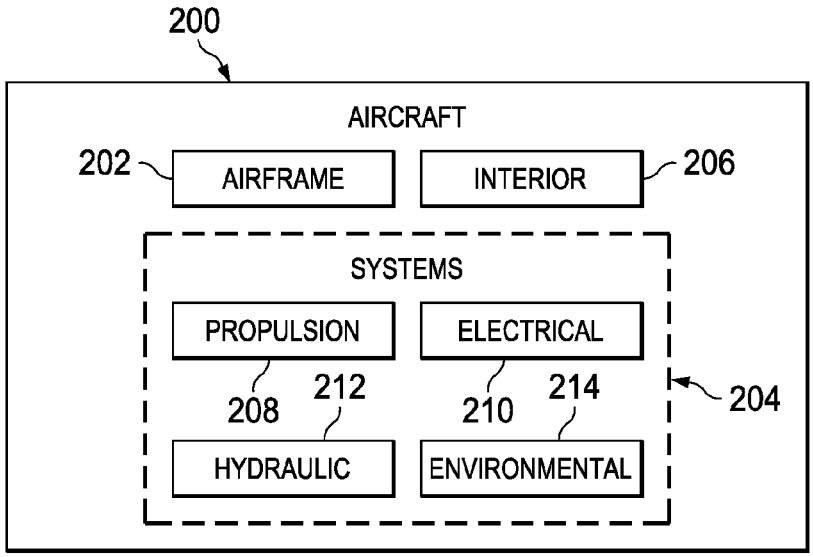
FIG. 2 is an illustration of an aircraft in which an advantageous embodiment may be implemented.

Referring more particularly to the drawings, embodiments of the disclosure may be described in the context of aircraft manufacturing and service method 100 as shown in FIG. 1 and aircraft 200 as shown in FIG. 2. Turning first to FIG. 1, an illustration of an aircraft manufacturing and service method is depicted in accordance with an advantageous embodiment. During pre-production, aircraft manufacturing and service method 100 may include specification and design 102 of aircraft 200 in FIG. 2 and material procurement 104.

During production, component and subassembly manufacturing 106 and system integration 108 of aircraft 200 in FIG. 2 takes place. Thereafter, aircraft 200 in FIG. 2 may go through certification and delivery 110 in order to be placed in service 112. While in service 112 by a customer, aircraft 200 in FIG. 2 is scheduled for routine maintenance and service 114, which may include modification, reconfiguration, refurbishment, and other maintenance or service.

Each of the processes of aircraft manufacturing and service method 100 may be performed or carried out by a system integrator, a third party, and/or an operator. In these examples, the operator may be a customer. For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

With reference now to FIG. 2, an illustration of an aircraft is depicted in which an advantageous embodiment may be implemented. In this example, aircraft 200 is produced by aircraft manufacturing and service method 100 in FIG. 1 and may include airframe 202 with a plurality of systems 204 and interior 206. Examples of systems 204 include one or more of propulsion system 208, electrical system 210, hydraulic system 212, and environmental system 214. Any number of other systems may be included. Although an aerospace example is shown, different advantageous embodiments may be applied to other industries, such as the automotive industry.

Apparatus and methods embodied herein may be employed during at least one of the stages of aircraft manufacturing and service method 100 in FIG. 1. As used herein, the phrase "at least one of", when used with a list of items, means that different combinations of one or more of the listed items may be used and only one of each item in the list may be needed. For example, "at least one of item A, item B, and item C" may include, for example, without limitation, item A or item A and item B. This example also may include item A, item B, and item C or item B and item C.

In one illustrative example, components or subassemblies produced in component and subassembly manufacturing 106 in FIG. 1 may be fabricated or manufactured in a manner similar to components or subassemblies produced while aircraft 200 is in service 112 in FIG. 1. As yet another example, a number of apparatus embodiments, method embodiments, or a combination thereof may be utilized during production stages, such as component and subassembly manufacturing 106 and system integration 108 in FIG. 1. A number, when referring to items, means one or more items. For example, a number of apparatus embodiments is one or more apparatus embodiments. A number of apparatus embodiments, method embodiments, or a combination thereof may be utilized while aircraft 200 is in service 112 and/or during maintenance and service 114 in FIG. 1. The use of a number of the different advantageous embodiments may substantially expedite the assembly of and/or reduce the cost of aircraft 200.

The different advantageous embodiments recognize and take into account a number of different solutions. For example, the different advantageous embodiments recognize and take into account that the use of human operators to apply sealant to structures may increase the time and/or expense needed to assemble the structures. The different advantageous embodiments also recognize and take into account that the use of a robot to apply sealant may reduce the time and/or expense needed to manufacture structures for an aircraft.

The different advantageous embodiments recognize and take into account that large computer-controlled machines may be used to apply sealant to different portions of a structure. This structure may be moved into a room or area in which the computer-controlled machine is located. The different advantageous embodiments also recognize and take into account that in some situations, these machines may be unable to reach some locations or spaces on and/or in the structure to apply the sealant.

The different advantageous embodiments recognize and take into account that some robots may have arms with end effectors that may be used to reach spaces that larger machines cannot reach. Additionally, the different advantageous embodiments recognize and take into account that these robots may not be able to control the amount of sealant applied to a structure as precisely as desired.

The different advantageous embodiments recognize and take into account that some end effectors used on a robot may control the amount of sealant applied using a plunger that moves forward to cause the sealant to flow out of a storage container. The plunger may be stopped and/or moved in the opposite direction to stop the flow of sealant from the container. The different advantageous embodiments recognize and take into account that this type of approach may not work in some cases in which pressurized cartridges may be present. These pressurized cartridges may continue to allow sealant to continue to flow from the cartridge even though the plunger may be moved in the opposite direction.

Thus, the different advantageous embodiments provide a method and apparatus for applying sealant. In one advantageous embodiment, a structure may be configured to hold a sealant container having a nozzle in which the structure is configured for attachment to a robotic arm. The apparatus also may include a sealant flow control system associated with the structure in which the sealant flow control system is configured to engage the nozzle to reduce and/or change the flow of sealant from the nozzle.

Figure 3:
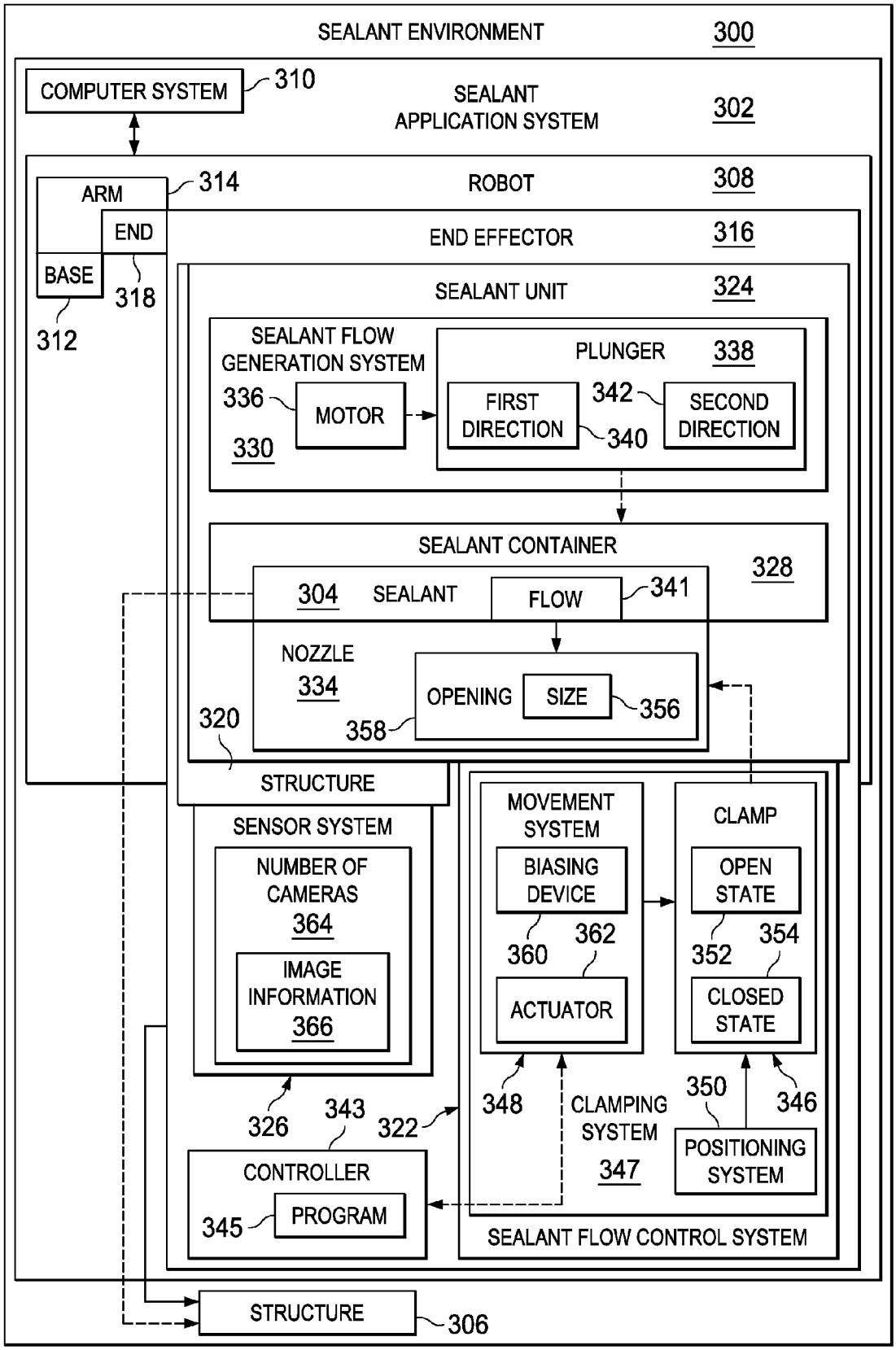
FIG. 3 is an illustration of a sealant environment in accordance with an advantageous embodiment.

With reference now to FIG. 3, an illustration of a sealant environment is depicted in accordance with an advantageous embodiment. Sealant environment 300 may be employed in different phases of aircraft manufacturing and service method 100 in FIG. 1. For example, without limitation, sealant environment 300 may be used during at least one of system integration 108, maintenance and service 114, and/or other suitable parts of aircraft manufacturing and service method 100 in FIG. 1.

In these illustrative examples, sealant application system 302 in sealant environment 300 may be used to apply sealant 304 to structure 306. Structure 306 may be, for example, without limitation, aircraft 200 in FIG. 2 or some structure within aircraft 200 in FIG. 2.

In this illustrative example, sealant application system 302 may comprise robot 308 and computer system 310. Computer system 310 may control the operation of robot 308 in applying sealant 304 to structure 306.

In these illustrative examples, robot 308 may comprise base 312, arm 314, end effector 316, and/or other suitable components. Base 312 may be a stationary base for robot 308. In other examples, base 312 may be moveable to different locations.

As depicted, arm 314 may have end effector 316 at end 318 of arm 314. End effector 316 may be a device configured to apply sealant 304 to structure 306. In these examples, arm 314 may be moveable on base 312. Arm 314 may move on base 312 such that end effector 316 may reach structure 306 to apply sealant 304.

In these illustrative examples, end effector 316 may comprise structure 320, sealant flow control system 322, sealant unit 324, and sensor system 326. Sealant unit 324 may comprise sealant container 328 and sealant flow generation system 330.

Sealant container 328 may have a housing or other suitable structure configured to hold sealant 304 and nozzle 334. Sealant container 328 may be a single-piece housing or a multi-piece housing that is part of structure 320.

In these illustrative examples, sealant flow generation system 330 causes sealant 304 to flow from sealant container 328 through nozzle 334. Sealant flow generation system 330, in these illustrative examples, comprises motor 336 and plunger 338. Motor 336 may be configured to move plunger 338 against sealant container 328. The movement of plunger 338 against sealant container 328 may be such that sealant 304 flows through nozzle 334.

Plunger 338 may be moved in first direction 340 to cause flow 341 of sealant 304 through nozzle 334 to occur. Additionally, motor 336 may move plunger 338 in second direction 342 to slow down and/or halt flow 341 of sealant 304 through nozzle 334. This movement of plunger 338 may not provide as much control with respect to flow 341 of sealant 304 as desired. For example, without limitation, movement of plunger 338 may not slow down and/or halt flow 341 as quickly as desired.

Sealant flow control system 322 may provide more precise control over flow 341 of sealant 304. In these illustrative examples, sealant flow control system 322 may take the form of clamping system 347. Sealant flow control system 322 may comprise clamp 346, movement system 348, and positioning system 350. Movement system 348 may move clamp 346 between open state 352 and closed state 354.

When in open state 352, sealant 304 may flow through nozzle 334 under the control of sealant flow generation system 330. In this state, sealant flow generation system 330 may cause sealant 304 to flow through nozzle 334 onto structure 306.

In closed state 354, clamp 346 may reduce size 356 of opening 358 in nozzle 334 to reduce flow 341 of sealant 304. This reduction in flow 341 may include ceasing flow 341, as well as reducing flow 341.

Additionally, the reduction in flow 341 of sealant 304 may be controlled automatically by controller 343. For example, without limitation, controller 343 may control movement system 348 to move clamp 346 into closed state 354 in response to a selected amount of sealant 304 being placed onto a location of structure 306. In this manner, controller 343 may reduce flow 341 of sealant 304.

In some illustrative examples, controller 343 may reduce flow 341 of sealant 304 in response to the lapse of a selected period of time. Further, in some illustrative examples, controller 343 may control movement system 348 based on program 345 running on controller 343.

In these illustrative examples, movement system 348 may comprise biasing device 360 and actuator 362. In these examples, biasing device 360 may be a spring. Biasing device 360 may bias clamp 346 towards open state 352. Actuator 362 may be used to bias clamp 346 to closed state 354.

In these depicted examples, positioning system 350 may be used to position biasing device 360 relative to nozzle 334. In this manner, clamp 346 may be positioned using positioning system 350 to engage nozzle 334 having different sizes, shapes, forms, and other dimensions or characteristics. In some illustrative examples, positioning system 350 may be controlled by controller 343.

Clamp 346 may be comprised of a number of materials. Clamp 346 may be comprised of any material that allows clamp 346 to control flow 341 of sealant 304 onto structure 306. In other words, clamp 346 may be comprised of any material having the strength required to reduce size 356 of opening 358 of nozzle 334 when clamp 346 is in closed state 354. For example, without limitation, clamp 346 may be comprised of metal, plastic, rubber, and/or other suitable materials.

In these illustrative examples, sensor system 326 may comprise number of cameras 364. Number of cameras 364 may generate image information 366. Image information 366 may include information about sealant 304 on structure 306. Further, image information 366 may be used to position end effector 316 with respect to structure 306 to apply sealant 304 to structure 306. Additionally, sensor system 326 may be used to inspect sealant 304 on structure 306 to determine whether sealant 304 is applied in a desired manner to meet various requirements that may be present.

The illustration of sealant environment 300 in FIG. 3 is not meant to imply physical or architectural limitations to a manner in which different advantageous embodiments may be implemented. Other components in addition to and/or in place of the ones illustrated may be used. Some components may be unnecessary in some advantageous embodiments. Also, the blocks are presented to illustrate some functional components. One or more of these blocks may be combined and/or divided into different blocks when implemented in different advantageous embodiments.

For example, in some advantageous embodiments, robot 308 may be controlled by a human operator rather than by computer system 310. In still other advantageous embodiments, additional robots or machines having structure 320 and sealant flow control system 322 may be used to apply sealant 304 to structure 306 or other structures.

Figure 4:
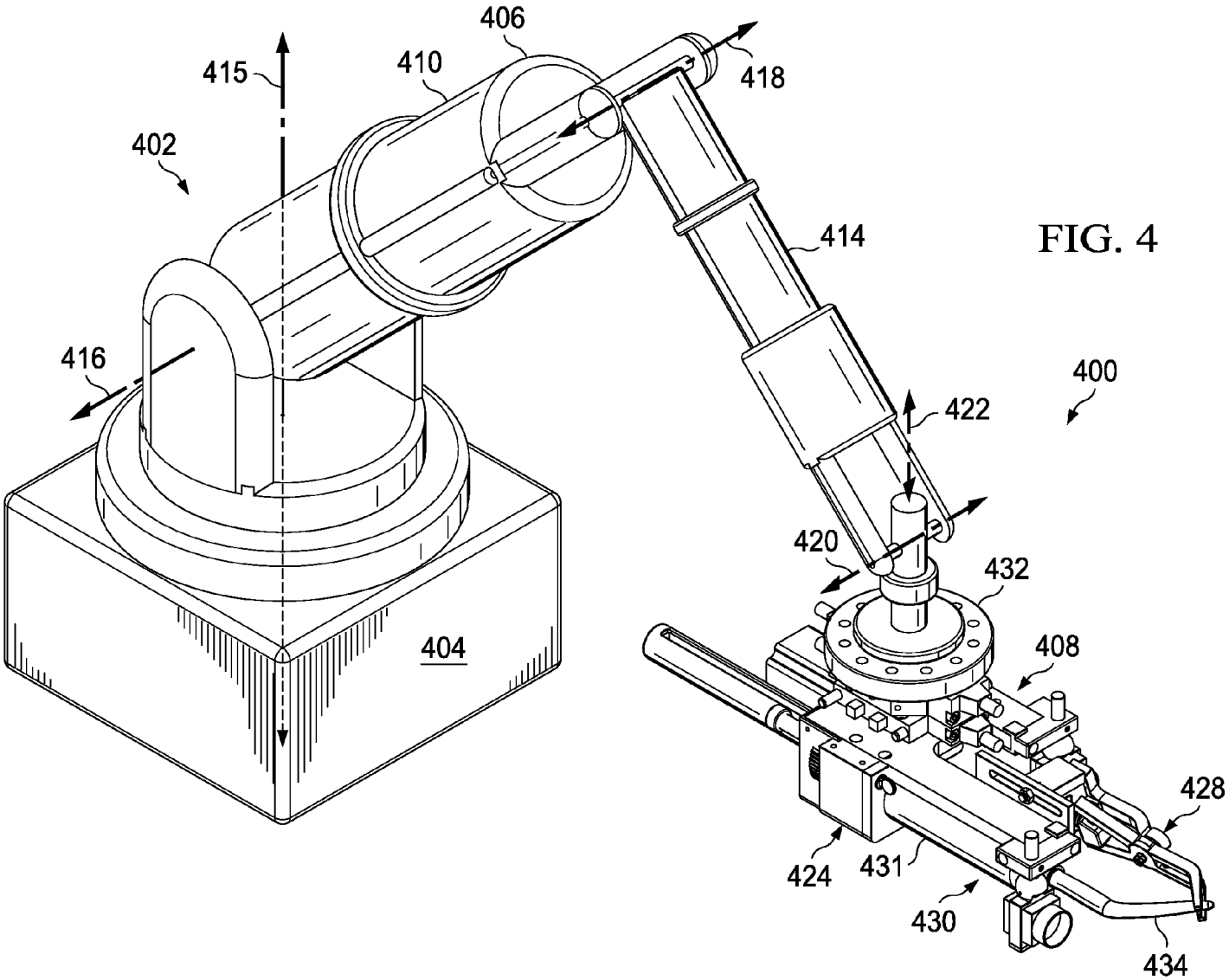
FIG. 4 is an illustration of a sealant application system in accordance with an advantageous embodiment.

With reference now to FIG. 4, an illustration of a sealant application system is depicted in accordance with an advantageous embodiment. Sealant application system 400 may be an example of one implementation for sealant application system 302 in FIG. 3.

As depicted, sealant application system 400 may comprise robot 402. Robot 402 may include base 404, arm 406, and end effector 408. Arm 406 may move about base 404 to position end effector 408. Further, arm 406 may rotate about axis 415 through base 404. Base 404 may be fixed and/or moved to another location. Base 404 also may be mounted on a vehicle and/or other structure configured to move base 404 to different locations.

In this illustrative example, arm 406 may have link 410 and link 414. Arm 406 may rotate link 410 about axis 416. Link 410 may rotate link 414 about axis 418. Link 414 may move end effector 408 about axis 420 and about axis 422. In this manner, arm 406 may position end effector 408 in a number of different positions.

In these illustrative examples, connector 432 connects end effector 408 to link 414 on arm 406. As depicted, end effector 408 may have structure 424, sealant flow control system 428, and sealant unit 430. Sealant unit 430 may comprise sealant container 431 having nozzle 434. Sealant flow control system 428 may be used to control the flow of sealant from sealant container 431 through nozzle 434.

Figure 5:
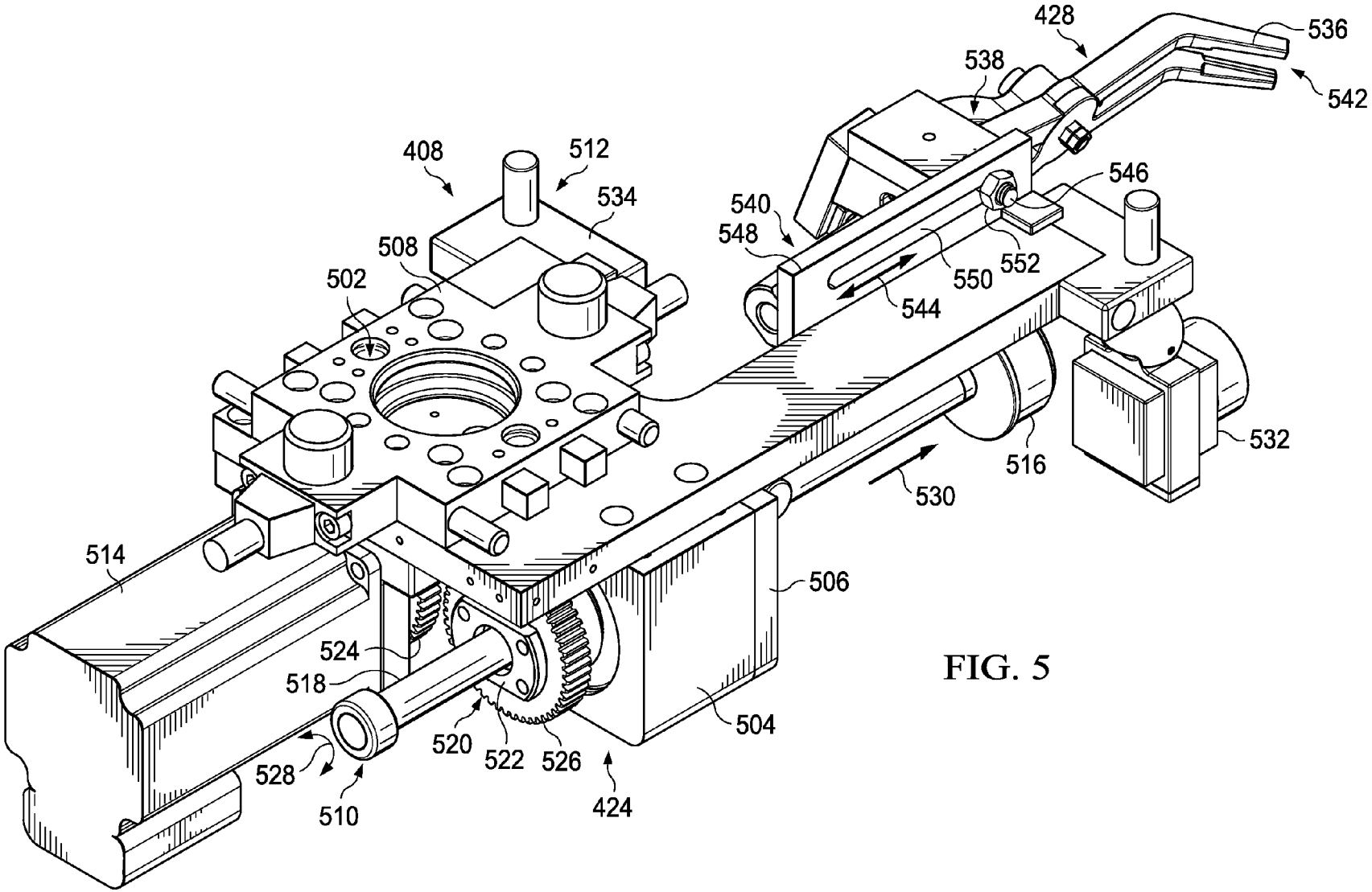
FIG. 5 is an illustration of a top perspective view of an end effector in accordance with an advantageous embodiment.

With reference now to FIG. 5, an illustration of a top perspective view of an end effector is depicted in accordance with an advantageous embodiment. In this illustrative example, a more-detailed view of end effector 408 in FIG. 4 is depicted. Structure 424 and sealant flow control system 428 for end effector 408 are shown in this figure. Sealant unit 430 in FIG. 4 is not shown in this figure.

As depicted, structure 424 may include interface system 502, housing 504, and locking plate 506. Locking plate 506 may be configured to hold sealant container 431 of sealant unit 430 in FIG. 4.

Interface system 502 may include interface plate 508. Interface plate 508 may be used to connect end effector 408 to, for example, without limitation, robot 402 in FIG. 4. In particular, connector 432 in FIG. 4 may be used with interface plate 508 to connect end effector 408 to link 414 of arm 406 for robot 402 in FIG. 4. Additionally, interface plate 508 may be used to connect end effector 408 to other links, other arms, other robots, and/or other suitable structures or devices.

In this illustrative example, end effector 408 also may include sealant flow generation system 510 and sensor system 512. In this depicted example, sealant flow generation system 510 may be part of sealant unit 430 in FIG. 4. Sealant flow generation system 510 may include motor 514, plunger 516, screw 518, gear system 520, and nut 522. Motor 514 may be connected to plunger 516 through screw 518, gear system 520, and nut 522. Motor 514 may be configured to move plunger 516.

For example, without limitation, motor 514 may run and cause gear system 520 to move. Gear system 520 may include gear 524 and gear 526 in this illustrative example. Movement of gear system 520 may turn screw 518 in the direction of arrow 528. Screw 518 may be connected to plunger 516 such that movement of screw 518 may move plunger 516. Movement of plunger 516 in the direction of arrow 530 may cause sealant to flow from sealant unit 430 through nozzle 434 in FIG. 4.

In this illustrative example, sensor system 512 includes camera system 532 and camera system 534. Camera system 532 may be used for viewing the location onto which sealant is to be applied. For example, camera system 532 may be positioned to view the part, fastener, and/or seam onto which the sealant is to be applied. Camera system 534 may be used for viewing the amount of sealant applied to a location.

As depicted in this example, sealant flow control system 428 may comprise clamp 536, movement system 538, and positioning system 540. Clamp 536 may be used to reduce the flow of sealant through nozzle 434 in FIG. 4. For example, movement system 538 may move clamp 536 between open state 542 and a closed state (not shown).

Positioning system 540 may be used to change the position of clamp 536 relative to nozzle 434 in FIG. 4. In particular, positioning system 540 may move clamp 536 along axis 544. As depicted, positioning system 540 may include post 546 and positioning plate 548. Post 546 may be moved in opening 550 of positioning plate 548 such that clamp 536 moves along axis 544. Additionally, nut 552 may be placed over post 546 to secure a position of post 546 in opening 550.

Figure 6:
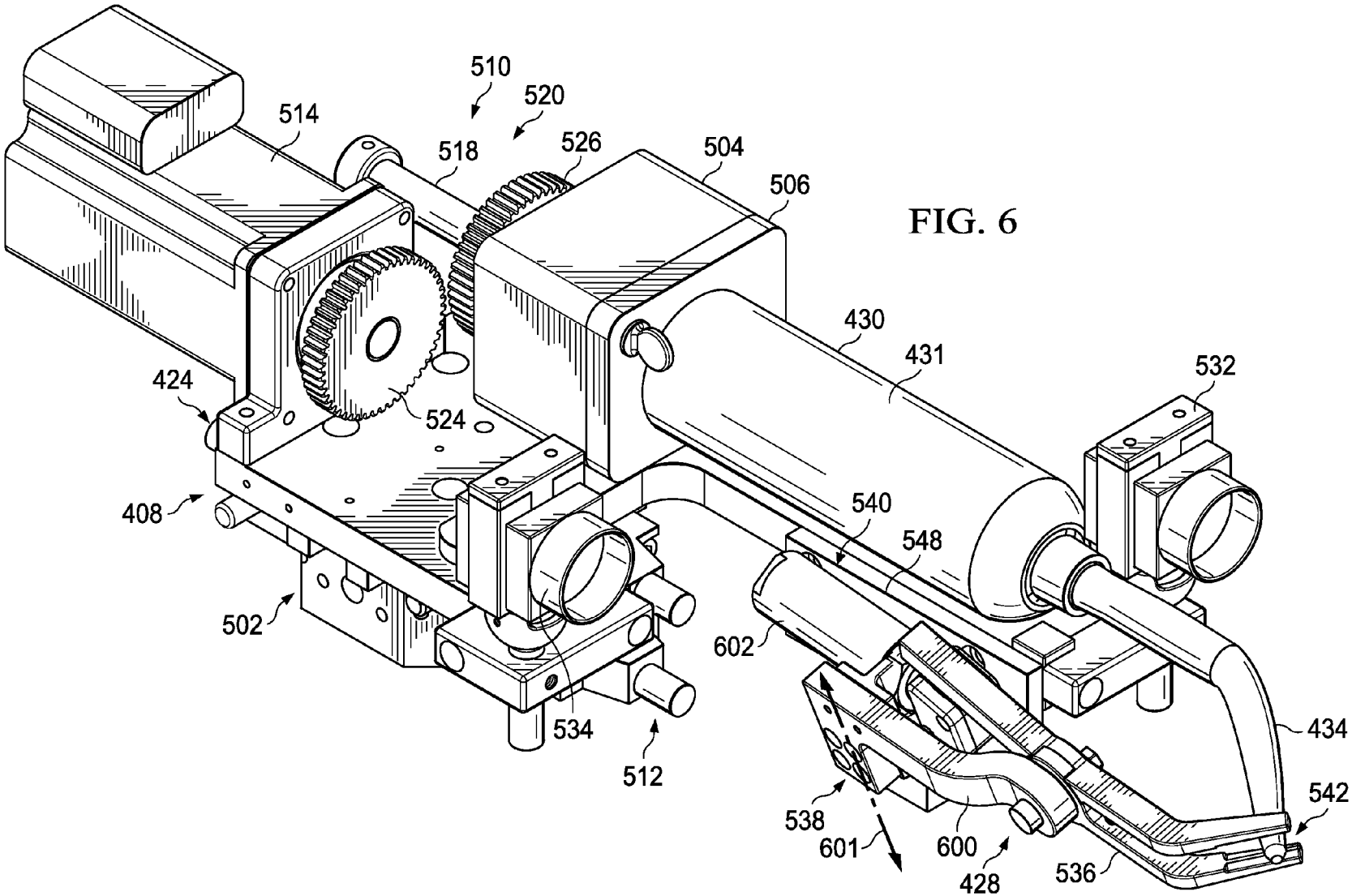
FIG. 6 is an illustration of a bottom perspective view of an end effector in accordance with an advantageous embodiment.

With reference now to FIG. 6, an illustration of a bottom perspective view of an end effector is depicted in accordance with an advantageous embodiment. In this illustrative example, end effector 408 is shown with sealant container 431 of sealant unit 430 held by locking plate 506.

As depicted in this example, operation of motor 514 may move gear system 520, which in turn, may move screw 518. Movement of screw 518 may move plunger 516 in FIG. 5. In this figure, plunger 516 (not shown) may be located within sealant unit 430. Movement of plunger 516 may cause sealant in sealant container 431 to flow through nozzle 434 in FIG. 4.

In this illustrative example, clamp 536 may be moved into a position relative to nozzle 434 using positioning system 540. Additionally, positioning system 540 may include bracket 600. Bracket 600 may be connected to clamp 536. Further, bracket 600 may be used to move clamp 536 about axis 601 in this illustrative example. Bracket 600 may also be referred to as a pivoting bracket.

As depicted, movement system 538 of sealant flow control system 428 may include actuator 602. Actuator 602 may be a pneumatic actuator in this illustrative example. Actuator 602 may be used to move clamp 536 between open state 542 and a closed state (not shown).

Figure 7:
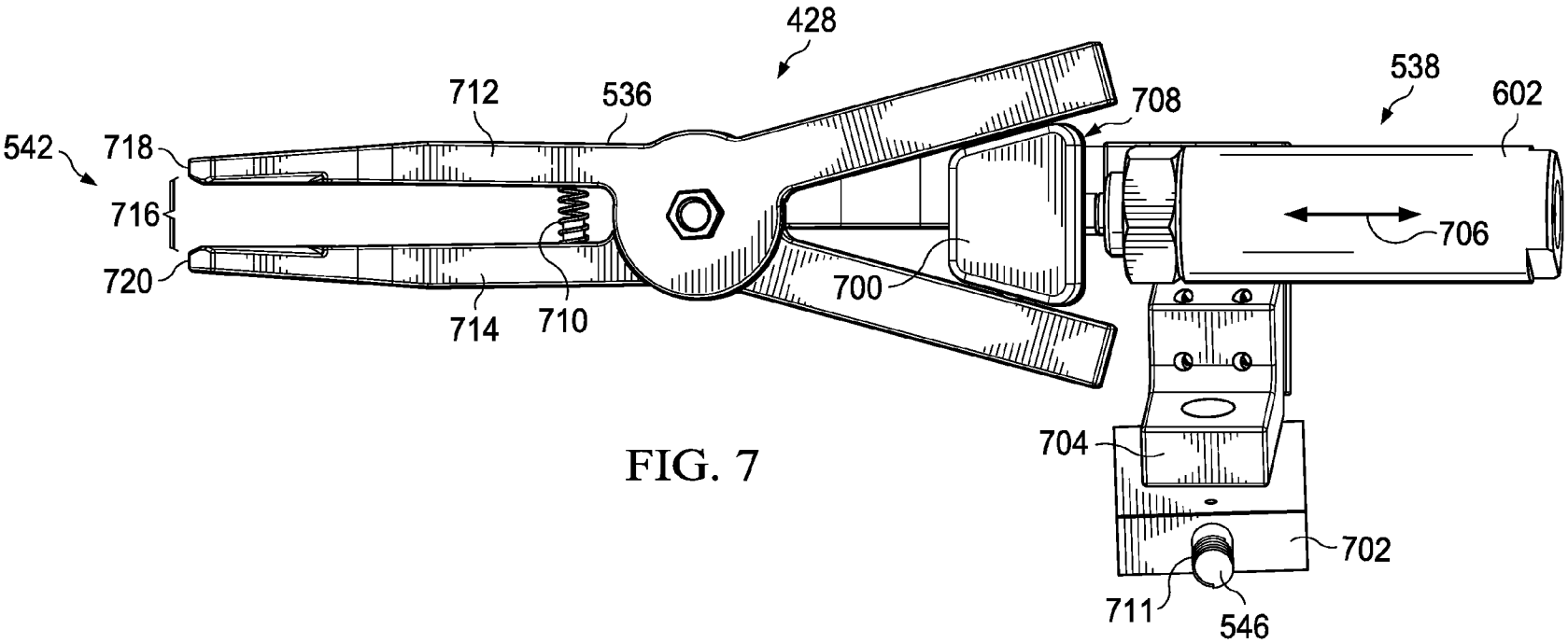
FIG. 7 is an illustration of a sealant flow control system with a clamp in an open state in accordance with an advantageous embodiment.

With reference now to FIG. 7, an illustration of a sealant flow control system with a clamp in an open state is depicted in accordance with an advantageous embodiment. In this illustrative example, clamp 536 for sealant flow control system 428 may be in open state 542.

As depicted in this example, movement system 538 may comprise actuator 602, wedge 700, linear adjustment base 702, and angular adjustment base 704. Actuator 602 may move along axis 706 to move wedge 700 along axis 706. With wedge 700 in position 708, clamp 536 may be in open state 542, as depicted. Further, spring 710 may bias clamp 536 towards open state 542.

Linear adjustment base 702 may have post 546 connected to linear adjustment base 702. As depicted, post 546 may have threads 711. Threads 711 may engage nut 552 in FIG. 5 when nut 552 is placed over post 546. Linear adjustment base 702 with post 546 may allow sealant flow control system 428 to move along axis 544 in FIG. 5. Angular adjustment base 704 may be connected to bracket 600 in FIG. 6. Movement of bracket 600 about axis 601 in FIG. 6 relative to angular adjustment base 704 may move clamp 536 about axis 601 in FIG. 6.

In this manner, sealant flow control system 428 may move both linearly and angularly such that sealant flow control system 428 may be moved into a position relative to nozzle 434 of sealant unit 430 in FIG. 4.

In this depicted example, clamp 536 may comprise member 712 and member 714. In open state 542, member 712 and member 714 may have distance 716 between end 718 of member 712 and end 720 of member 714.

Figure 8:
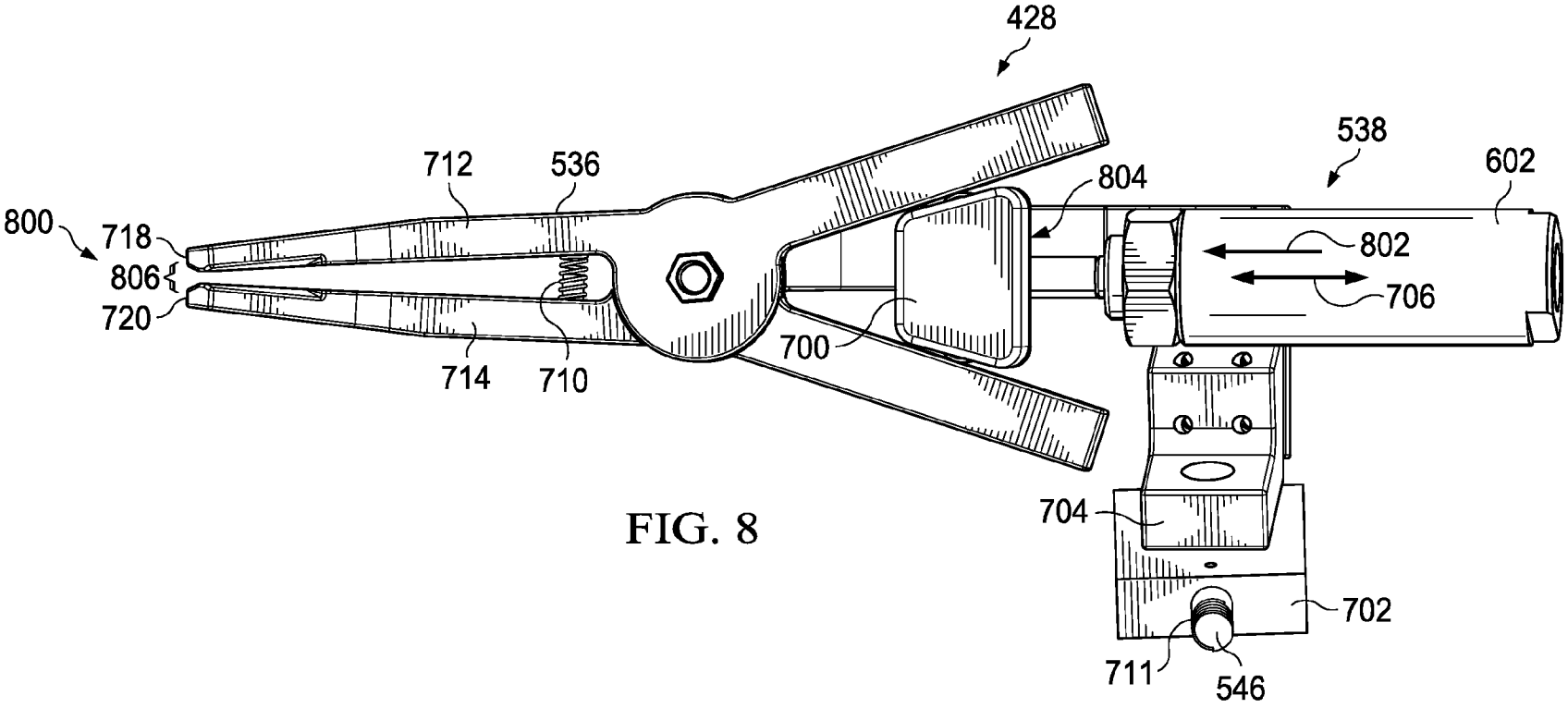
FIG. 8 is an illustration of a sealant flow control system with a clamp in a closed state in accordance with an advantageous embodiment.

With reference now to FIG. 8, an illustration of a sealant flow control system with a clamp in a closed state is depicted in accordance with an advantageous embodiment. In this illustrative example, clamp 536 is depicted in closed state 800.

In this depicted example, actuator 602 has been moved in the direction of arrow 802 to move wedge 700 from position 708 in FIG. 7 to position 804. With wedge 700 in position 804, clamp 536 may be in closed state 800.

As depicted, member 712 and member 714 have moved in response to wedge 700 moving to position 804. Movement of member 712 and member 714 changes the distance between end 718 and end 720 to distance 806. Distance 806 may be a smaller distance as compared to distance 716 in FIG. 7.

When end 718 and end 720 are placed around a nozzle, such as nozzle 434 in FIG. 4, moving clamp 536 to closed state 800 may reduce the size of an opening (not shown) in nozzle 434. This reduction may reduce the flow of sealant through nozzle 434 in FIG. 4.

Figure 9:
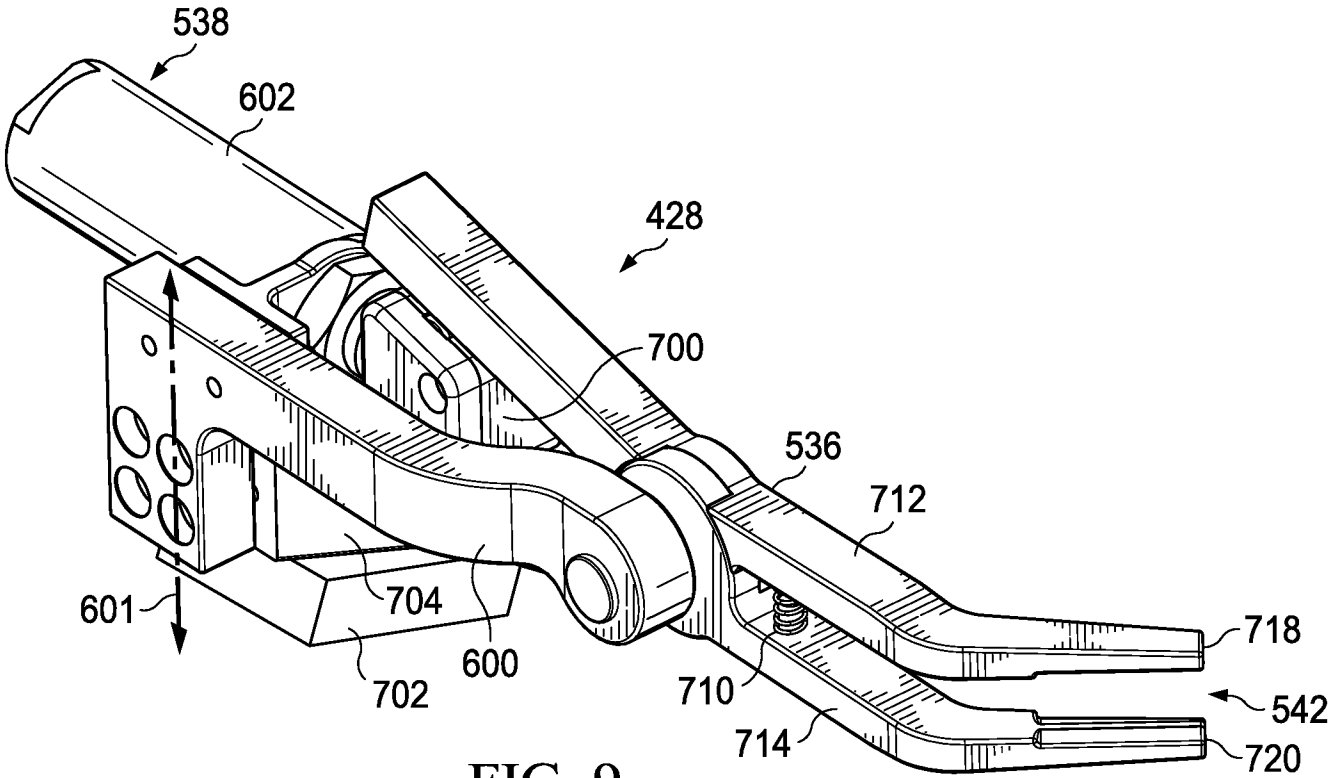
FIG. 9 is an illustration of a perspective view of a sealant flow control system in accordance with an advantageous embodiment.

With reference now to FIG. 9, an illustration of a perspective view of a sealant flow control system is depicted in accordance with an advantageous embodiment. In this illustrative example, bracket 600 may be more clearly shown. Movement of bracket 600 with angular adjustment base 704 may allow sealant flow control system 428 to be moved about axis 601 in this illustrative example. As depicted, clamp 536 may be in open state 542.

Figure 10:
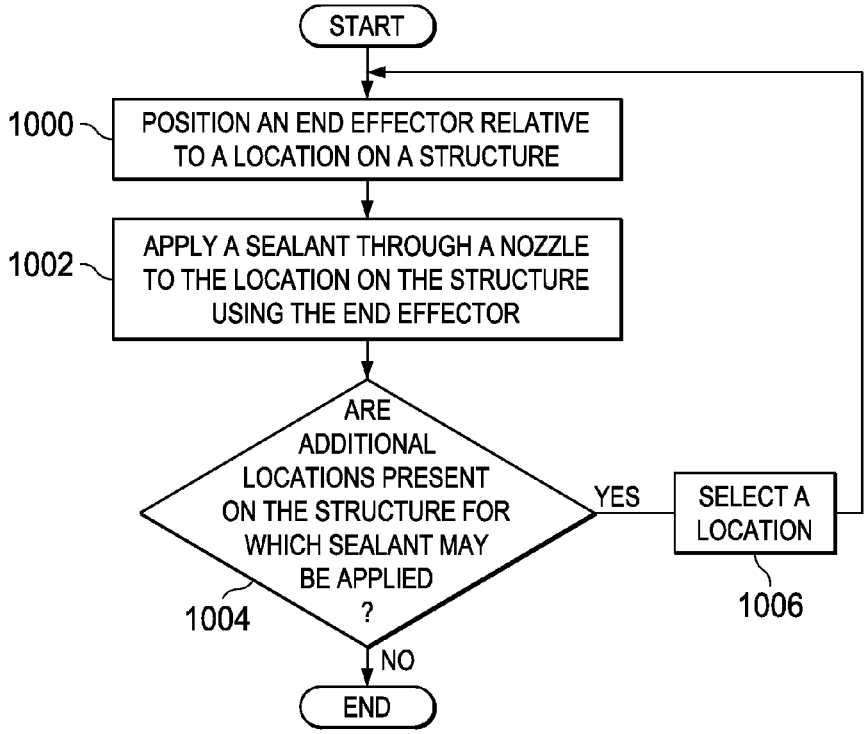
FIG. 10 is an illustration of a flowchart of a process for applying sealant to a structure in accordance with an advantageous embodiment.

With reference now to FIG. 10, an illustration of a flowchart of a process for applying sealant to a structure is depicted in accordance with an advantageous embodiment. The process illustrated in FIG. 10 may be implemented using sealant environment 300 in FIG. 3. In these illustrative examples, sealant 304 may be applied to structure 306 for aircraft 200. Of course, sealant 304 may be applied to other types of structures for other objects, depending on the particular implementation. For example, without limitation, sealant 304 may be applied to structures for automobiles, buildings, manufacturing facilities, ships, satellites, spacecraft, and other suitable objects.

The process may begin by positioning end effector 316 relative to a location on structure 306 (operation 1000). In these illustrative examples, end effector 316 may include structure 320 and sealant flow control system 322. Thereafter, sealant 304 may be applied through nozzle 334 to the location on structure 306 using end effector 316 (operation 1002).

A determination may then be made as to whether additional locations are present on structure 306 for which sealant 304 may be applied (operation 1004). If additional locations are present, a location is selected (operation 1006), with the process returning to operation 1000, as described above. Otherwise, the process terminates.

Figure 11:
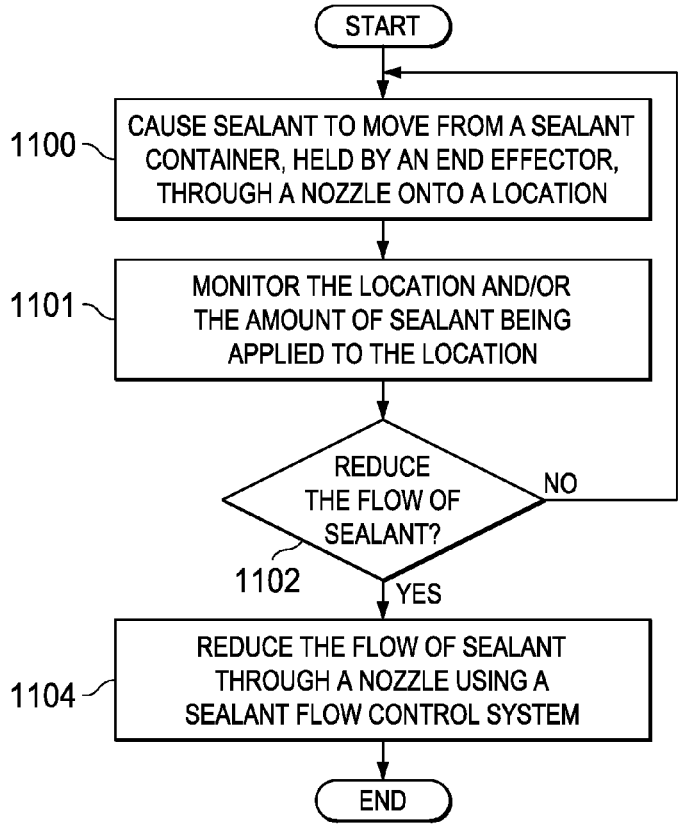
FIG. 11 is an illustration of a flowchart of a process for controlling a flow of sealant through a nozzle in a sealant container in accordance with an advantageous embodiment.

With reference now to FIG. 11, an illustration of a flowchart of a process for controlling a flow of sealant through a nozzle in a sealant container is depicted in accordance with an advantageous embodiment. The process illustrated in FIG. 11 may be an example of operations performed in operation 1002 in FIG. 10.

The process may begin by causing sealant 304 to move from sealant container 328, held by end effector 316, through nozzle 334 onto a location (operation 1100). The location may be on, for example, without limitation, structure 306.

The process may monitor the location and/or the amount of sealant 304 being applied to the location (operation 1101). This monitoring may be performed using sensor system 326. For example, without limitation, number of cameras 364 may generate image information about the amount of sealant 304 being applied to the location, as well as whether the sealant is being applied where expected at the location.

A determination may then be made as to whether to reduce flow 341 of sealant 304 (operation 1102). In operation 1102, the determination may be made based on whether a desired amount of sealant 304 has been applied to the location and/or whether the sealant is being applied where expected at the location. Flow 341 of sealant 304 may be reduced by reducing flow 341 of sealant 304 to a selected level of flow or halting flow 341 of sealant 304. If flow 341 of sealant 304 is not to be reduced, the process returns to operation 1100.

Otherwise, the process may reduce flow 341 of sealant 304 through nozzle 334 using sealant flow control system 322 (operation 1104), with the process terminating thereafter.

The flowcharts and block diagrams in the different depicted embodiments illustrate the architecture, functionality, and operation of some possible implementations of apparatus and methods in different advantageous embodiments. In this regard, each block in the flowcharts or block diagrams may represent a module, segment, function, and/or a portion of an operation or step. In some alternative implementations, the function or functions noted in the block may occur out of the order noted in the figures. For example, in some cases, two blocks shown in succession may be executed substantially concurrently, or the blocks may sometimes be executed in the reverse order, depending upon the functionality involved. Also, other blocks may be added in addition to the illustrated blocks in a flowchart or block diagram.

Thus, the different advantageous embodiments provide a method and an apparatus for applying sealant to a structure. In one advantageous embodiment, the apparatus may comprise a structure and a sealant flow control system. The structure may be configured to hold a sealant container having a nozzle in which the structure is configured for attachment to a robotic arm. The sealant flow control system may be associated with the structure in which the sealant flow control system may be configured to engage the nozzle to reduce a flow of sealant from the nozzle.

With these and other advantageous embodiments, the amounts of time and expense needed to apply sealant to structures may be reduced. Further, the different advantageous embodiments may reduce the amount of sealant that may be lost or wasted using presently available systems.

By controlling the flow of sealant through a nozzle more quickly using a sealant flow control system, clean up or removal of excess sealant from a location may be reduced.

The description of the different advantageous embodiments has been presented for purposes of illustration and description and is not intended to be exhaustive or limited to the embodiments in the form disclosed. Many modifications and variations will be apparent to those of ordinary skill in the art.

Further, different advantageous embodiments may provide different advantages as compared to other advantageous embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A sealant application system for applying sealant to a structure, the sealant application system comprising:

a structure configured to hold a sealant container having a nozzle in which the structure is configured for attachment to a robotic arm; and a sealant flow control system associated with the structure in which the sealant flow control system is configured to engage the nozzle of the sealant container to reduce a flow of sealant from the nozzle, the sealant flow control system comprising:

a clamp having a first member and a second member, in which the first member has a first end, the second member has a second end, the clamp may be moved between an open state and a closed state, and a distance between the first end and the second end is smaller when the clamp is in the closed state than when the clamp is in the open state; and a movement system configured to move the clamp between the open state and the closed state; and a sealant flow generation system in which the sealant flow generation system causes the sealant to move from the sealant container through the nozzle, the sealant flow generation system comprising a plunger configured to engage the sealant container in which the plunger causes the sealant in the sealant container to move through the nozzle when moved in a direction towards the nozzle.

2. The sealant application system of claim 1, wherein the sealant flow control system is configured to clamp the nozzle such that an opening in the nozzle is reduced in size.

3. The sealant application system of claim 1, wherein the movement system comprises:

an actuator configured to move the clamp between the open state and the closed state.

4. The sealant application system of claim 3, wherein the actuator is configured to move the clamp towards the closed state and the movement system further comprises:

a biasing device configured to bias the clamp towards the open state.

5. The sealant application system of claim 4, wherein the biasing device is a spring.

6. The sealant application system of claim 1, wherein the sealant flow control system further comprises: a positioning system configured to position the clamp relative to the nozzle such that the clamp reduces a size of an opening in the nozzle when in the closed state or an interim state.

7. The sealant application system of claim 1 further comprising:

a sensor system associated with the structure, wherein the sensor system is configured to provide information about a position of the nozzle.

8. The sealant application system of claim 7, wherein the sensor system comprises:

a number of cameras configured to generate image information about an area around the nozzle.

9. The sealant application system of claim 1 further comprising:

the robotic arm.

10. The sealant application system of claim 1, wherein the sealant flow generation system further comprises:

a motor connected to the plunger, wherein the motor is configured to move the plunger.

11. The sealant application system of claim 10 further comprising:

a gear system connecting the motor to the plunger, wherein the gear system is configured to move the plunger.

12. The sealant application system of claim 1, wherein the structure and the sealant flow control system form an end effector for a robot.

13. A sealant application system for applying sealant to a structure for an aircraft, the sealant application system comprising:

a structure configured to hold a sealant container having a nozzle in which the structure is configured for attachment to a robotic arm;

and a sealant flow control system associated with the structure in which the sealant flow control system is configured to engage the nozzle to reduce a flow of sealant from the nozzle and to clamp the nozzle such that an opening in the nozzle is reduced in size, in which the structure and the sealant flow control system form an end effector for a robot, and in which the sealant flow control system comprises:

a clamp having a first member and a second member, in which the first member has a first end, the second member has a second end, the clamp may be moved between an open state and a closed state, and a distance between the first end and the second end is smaller when the clamp is in the closed state than when the clamp is in the open state;

a movement system configured to move the clamp between the open state and the closed state or an interim state in which the movement system comprises:

an actuator configured to move the clamp between the open state and the closed state; and a spring configured to bias the clamp towards the open state; and a positioning system configured to position the clamp relative to the nozzle such that the clamp reduces a size of the opening in the nozzle when in the closed state;

a sensor system associated with the structure in which the sensor system is configured to provide information about a position of the nozzle and comprises a number of cameras configured to generate image information about an area around the nozzle;

a sealant flow generation system in which the sealant flow generation system causes the sealant to move from the sealant container through the nozzle in which the sealant flow generation system comprises:

a plunger configured to engage the sealant container in which the plunger causes the sealant in the sealant container to move through the nozzle when moved in a direction towards the nozzle; and a motor connected to the plunger in which the motor is configured to move the plunger;

a gear system connecting the motor to the plunger, wherein the gear system is configured to move the plunger; and the robotic arm.

14. A method for applying sealant, the method comprising:

applying the sealant through a nozzle from a sealant container of a sealant application system to a location on a structure using an end effector, the sealant application system comprising:

the end effector, in which the end effector comprises a structure configured to hold the sealant container having the nozzle in which the structure is configured for attachment to a robotic arm; and a sealant flow control system associated with the structure in which the sealant flow control system is configured to engage the nozzle of the sealant container to reduce a flow of sealant from the nozzle, the sealant flow control system comprising:

a clamp having a first member and a second member, in which the first member has a first end, the second member has a second end, the clamp may be moved between an open state and a closed state, and a distance between the first end and the second end is smaller when the clamp is in the closed state than when the clamp is in the open state; and a movement system configured to move the clamp between the open state and the closed state; and a sealant flow generation system in which the sealant flow generation system causes the sealant to move from the sealant container through the nozzle, the sealant flow generation system comprising a plunger configured to engage the sealant container in which the plunger causes the sealant in the sealant container to move through the nozzle when moved in a direction towards the nozzle; and responsive to a desired amount of sealant being applied to the location, clamping the nozzle with the sealant flow control system configured to engage the nozzle to reduce a flow of the sealant from the nozzle.

15. The method of claim 14, wherein the step of causing the sealant to move from the sealant container through the nozzle onto the location comprises:

causing the sealant to move from the sealant container through the nozzle onto the location using the sealant flow generation system.

16. A method for applying a sealant to a structure for an aircraft, the method comprising:

positioning an end effector relative to a location on the structure selected from a group comprising one of a fastener, a seam, and an edge of the structure, in which the end effector comprises a structure configured to hold a sealant container having a nozzle in which the structure is configured for attachment to a robotic arm and a sealant flow control system associated with the structure in which the sealant flow control system is configured to engage the nozzle of the sealant container to reduce a flow of sealant from the nozzle, in which the sealant flow control system comprises a clamp having a first member and a second member, in which the first member has a first end, the second member has a second end, the clamp may be moved between an open state and a closed state, and a distance between the first end and the second end is smaller when the clamp is in the closed state than when the clamp is in the open state; and a movement system configured to move the clamp between the open state and the closed state;

causing the sealant to move from the sealant container through the nozzle onto the location using a sealant flow generation system for the end effector in which the sealant flow generation system comprises a plunger configured to engage the sealant container and a motor connected to the plunger in which the motor is configured to move the plunger against the sealant and movement of the plunger in a direction towards the nozzle causes the sealant in the sealant container to move through the nozzle; and reducing the flow of the sealant when a desired amount of the sealant has been applied to the location.

17. The sealant application system of claim 1, wherein the first end is configured to engage an exterior of the nozzle and the second end is configured to engage the exterior of the nozzle, and wherein the first end and the second end are configured to compress the exterior of the nozzle when the clamp is in the closed state.

18. The sealant application system of claim 1, wherein the clamp is configured to change the shape of the nozzle when the clamp is in the closed state.

19. The sealant application system of claim 1, wherein the first member is configured to engage an exterior of the nozzle and the second member is configured to engage the exterior of the nozzle.

* * * * *